US005668565A

United States Patent [19]

Robinson

[11] Patent Number: 5,668,565

[45] Date of Patent: Sep. 16, 1997

[54] FLEXIBLE FEED LINE FOR AN ANTENNA SYSTEM

[75] Inventor: Anthony D. Robinson, Leesburg, Va.

[73] Assignee: Orbital Science Corporation, Dulles, Va.

[21] Appl. No.: 362,047

[22] Filed: Dec. 22, 1994

[51] Int. Cl.[6] ..... H01Q 1/36; H01Q 15/20

[52] U.S. Cl. ..... 343/895; 343/915; 333/34

[58] Field of Search ..... 343/880, 895, 343/881, 882, 905, 915; 333/156, 160, 161, 162, 34, 236, 245, 260

[56] References Cited

U.S. PATENT DOCUMENTS

| | | | |
|---|---|---|---|
| 3,059,322 | 10/1962 | Teague | 29/600 |
| 3,702,481 | 11/1972 | Koller et al. | 343/895 |
| 3,836,979 | 9/1974 | Kurland et al. | 343/895 |
| 3,913,109 | 10/1975 | Owen | 343/880 |
| 4,068,238 | 1/1978 | Acker | 343/895 |
| 4,475,111 | 10/1984 | Gittinger et al. | 343/915 |
| 4,780,727 | 10/1988 | Seal et al. | 343/895 |
| 4,905,972 | 3/1990 | Scoven | 267/152 |
| 5,013,013 | 5/1991 | Spedding | 267/165 |
| 5,089,829 | 2/1992 | Haruyama et al. | 343/852 |
| 5,170,176 | 12/1992 | Yasunaga et al. | 343/895 |
| 5,198,831 | 3/1993 | Burrell et al. | 343/895 |
| 5,227,808 | 7/1993 | Davis | 343/915 |
| 5,234,761 | 8/1993 | Barnes et al. | 428/336 |

*Primary Examiner*—Donald T. Hajec
*Assistant Examiner*—Tan Ho
*Attorney, Agent, or Firm*—Jenner & Block

[57] ABSTRACT

A flexible feed line is provided for use with a selectively deployable antenna system. The feed line is resilient and expandable so that it can maintain connections within antenna feed circuits while the antenna is being deformed or moved for stowage. An antenna system for use with the feed lines of the present invention may consist of a deployable quadrifilar helical antenna elements having four resilient conductive strips bonded thereto. Flexible feed lines are attached to each of the conductive helical strips. The feed lines expand to accommodate the shape of the antenna elements when compressed for stowing and return to their operating shape when deployed, thus providing identical feed paths to each of the antenna conductors when the antenna system is deployed.

23 Claims, 5 Drawing Sheets

FLEXIBLE FEED LINE FOR AN ANTENNA SYSTEM

FIELD OF THE INVENTION

The invention relates generally to antenna feed lines and more particularly to an antenna system having a flexible and resilient feed conductor so that the antenna can maintain its operative connections while being stowed and redeployed.

BACKGROUND OF THE INVENTION

Many applications require the use of a transportable antenna system. In such applications, it is frequently desirable to utilize an antenna that is capable of being folded into a compact volume for transport and later deployed into an extended operating configuration. As a result, many attempts have been made to design collapsible antenna systems of various kinds. Several such antenna designs are described in the copending U.S. patent applications, entitled "Self-Deploying Helical Structure", Ser. No. 08/192,324, now abandoned and "Axially Arrayed Helical Antenna", Ser. No. 08/191,247, both filed Feb. 4, 1994, and assigned to the assignee of the present invention.

An advantage found in some of these prior antenna systems is that the antenna can be stowed and redeployed without the need to disconnect and reconnect the antenna to its signal receiver/transmitter circuits. Typically, these antenna systems collapse and expand longitudinally toward and away from the base of the antenna where the connections to the feed lines, which connect the antenna to the signal circuits, are found. As a result, the feed lines are largely unaffected when the antenna system is stowed or redeployed.

In many applications, however, an antenna system having feed lines that are capable of contraction and expansion is found to be desirable. For example, in satellite communication applications it is desirable that the antenna system be collapsible about its entire radius to occupy as little volume as possible while the antenna is being transported to minimize the volume of spacecraft payload. In such applications, it is also desirable that the antenna redeploy to an operating configuration automatically with connections to receiver/transmitter circuits maintained. The above-referenced co-pending applications describe such a self-deployable antenna system that can be collapsed radially into a compact volume. However, because the connections to the signal circuits are also subject to movement and stress in these designs, self-deployable feed lines are required.

The materials and structure typically used as feed lines have disadvantages when used with a deployable antenna system. For example, when ferrous metals are used in a feed line, oxidation can occur at the metal-to-metal junction between the feed line and the antenna element, which can create a phenomenon known as passive intermodulation ("PIM"). PIM can result in garbled data transmissions over the frequency spectrum of the transmitted signal.

Moreover, non-ferrous metals, such as a copper wire segment, also have significant disadvantages when used as a feed line. Although somewhat resilient, copper wire segments fail to retain their shape when the antenna to which they are connected is collapsed and expanded during stowage and redeployment. When this occurs, adjacent feed lines in a multiple conductor antenna system can become entangled, which interferes with antenna redeployment.

Where an antenna element has multiple conductors, such as in a quadrifilar helical antenna, to provide a proper phase progression and amplitude among the conductors the feed lines must provide an identical signal path from the signal circuits to each antenna conductor. When, for example, the individual conductors are fed radially, each line must lie in the same plane if the antenna is to perform properly. Because, as noted above, copper wire and other materials typically used as feed lines fail to retain their original shape and spatial orientation when the antenna to which they are connected redeploys after stowage in a folded configuration, the individual feed lines of a multiple-conductor antenna element can be out of plane with respect to each other. As a result, the feed lines fail to provide identical signal paths causing degradation of the RF signal pattern of the antenna system.

Although a more flexible feed line can be made of copper wire—or another non-ferrous conductor—formed into a spring through heat-treating, this construction tends to be too stiff for the lightweight antenna systems that are desirable in spacecraft applications. As a result, the feed springs resist redeployment when the antenna system expands into its operating configuration. In addition, the heat-treated copper material is prone to fatigue and premature damage caused by bending stresses exerted on the feed spring when the antenna system is stowed and redeployed.

Therefore, it would be desirable to provide an antenna system having highly resilient and durable feed lines that are deployable from a compact stowed configuration to an extended operating configuration while maintaining their original shape and spatial orientation.

SUMMARY OF THE INVENTION

The principal object of this invention is to provide an improved antenna feed line for use with a deployable antenna system. More specifically, it is an object of the invention to provide a lightweight, resilient antenna feed line made of a non-ferrous material that is capable of being deformed when the antenna system is stowed while returning to its original shape and orientation when the antenna is redeployed. An antenna system using the feed lines of the present invention can be compressed in a variety of ways into a convenient volume for stowage and then automatically redeployed into an operating configuration.

In accordance with the present invention, a deployable flexible feed line includes connectors to a signal receiver/transmitter circuit and to an antenna element which receives/transmits these signals and a resilient conducting section extending between the connectors. The resilient conductor is capable of being compressed, expanded and flexed and is durable so that it maintains its original shape after repeated stowage and deployment. As a result, the feed line flexes, expands or contracts to accommodate the collapsed shape of the antenna element when stowed and reverts to its original operating shape when the antenna element redeploys with connections to signal circuits maintained.

In the preferred embodiment, the resilient portion of the feed line is made of a resilient strip of non-conductive material with a strip of conductive material bonded thereto. The resilient section can be wound or folded in a zig-zag pattern of successive folds or fanfolds forming a spring-like section to permit stretching and compression. This construction is light weight and highly resilient and can withstand the substantial bending stresses that are exerted on the feed line when the antenna system is stowed and redeployed. In addition, the feed line has a rigid base section adjacent to the receiver/transmitter connector. The rigid base provides additional support and stress relief for the signal connectors of the feed line.

In a second embodiment of the invention, the feed line includes two resilient sections branching off from the rigid base in a "Y" configuration. Each branch can be wound or folded in a spring-like fashion, as above, and each terminates on one end in a signal connector to an antenna element. This alternative configuration provides a smoother transition from the signal source output impedance to the input impedance of the individual antenna conductors of the antenna element.

In a preferred embodiment, an antenna system using the feed lines of the present invention includes a self-deployable quadrifilar helical antenna system element. Each antenna comprises conductive resilient helical strips mounted to a top ring, a bottom ring and several intermediate rings. Such a helical structure can be distorted longitudinally or radially to fit into a compact volume for stowage. Later, when released, the structure is self-deployed by the energy stored in the resilient helical strips as they resume their helical configuration. Each antenna element is fed by four feed lines extending radially from a boom segment. When stowed, the feed lines expand or compress to accommodate the elliptical shape of the antenna element. When the antenna system is redeployed, the feed lines return to their original shape, i.e., slightly compressed or expanded, respectively, so that the feed lines present identical signal paths to the receiver/transmitter circuits.

Other objects and features of the invention will be apparent from the following description and from the drawings.

DETAILED DESCRIPTION OF THE PREFERRED EMBODIMENT

Figure 1:
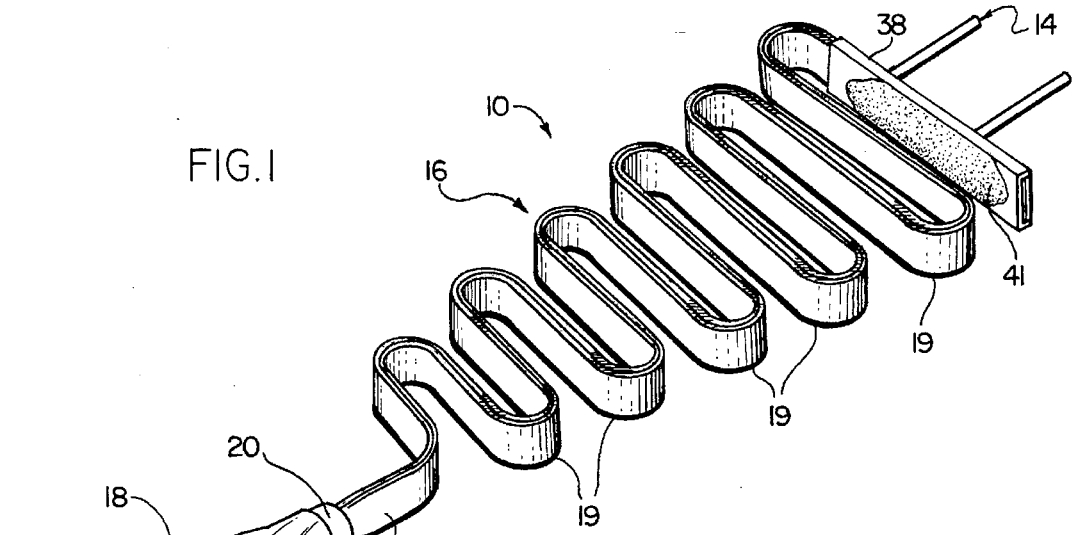
FIG. 1 is a perspective view of a feed line of the present invention.

FIG. 1 illustrates the preferred embodiment of a feed line 10 designed in accordance with the present invention. Feed line 10 has a first connector 12 for connecting the feed line 10 to a receiver/transmitter circuit, and a second pair of connectors 14 for connecting the feed line to an antenna element. In addition, feed line 10 includes a resilient, expandable and compressible conductive section 16 between connectors 12 and 14. Resilient section 16 gives the feed line flexibility to accommodate shape distortions caused by antenna stowage and durability to maintain connections between the signal transmitter/receiver and the antenna element in the face of such repeated stresses. Typically, a base section 18 is also disposed between resilient section 16 and signal circuit board connector 12. Connector 12 can be any one of a number of commercially available types, for example, a Huber Suhner connector, part number 16 MMCX50-1-1C/111. In contrast with resilient section 16, base section 18 is rigid and inflexible, thus providing additional support and stress relief from the bending stresses that occur at the connector 12 when feed line 10 expands and contracts. Resilient section 16 is connected to base section 18 at a flexible base joint 20.

In the preferred embodiment, resilient section 16 is composed of a thin strip of resilient, conductive material. The resilient strip is folded in a zig-zag pattern of multiple fanfolds forming a spring-like section. Although any number of folds of resilient material can be used with the present invention, it has been discovered that when fewer than six folds is used, the feed line is prone to breakage due to fatigue caused by excessive stretching of the resilient material of spring section 16. In addition, as can be seen in FIG. 1, the folds of spring section 16 are of progressively greater length as the conductor winds from base section 18 to antenna element connector 14. This taper forms a transition section that provides a gradual, uniform impedance transformation between the lower impedance of the signal transmitter/receiver output terminals and the higher input impedance of the antenna element providing ideal impedance matching conditions.

Figure 2:
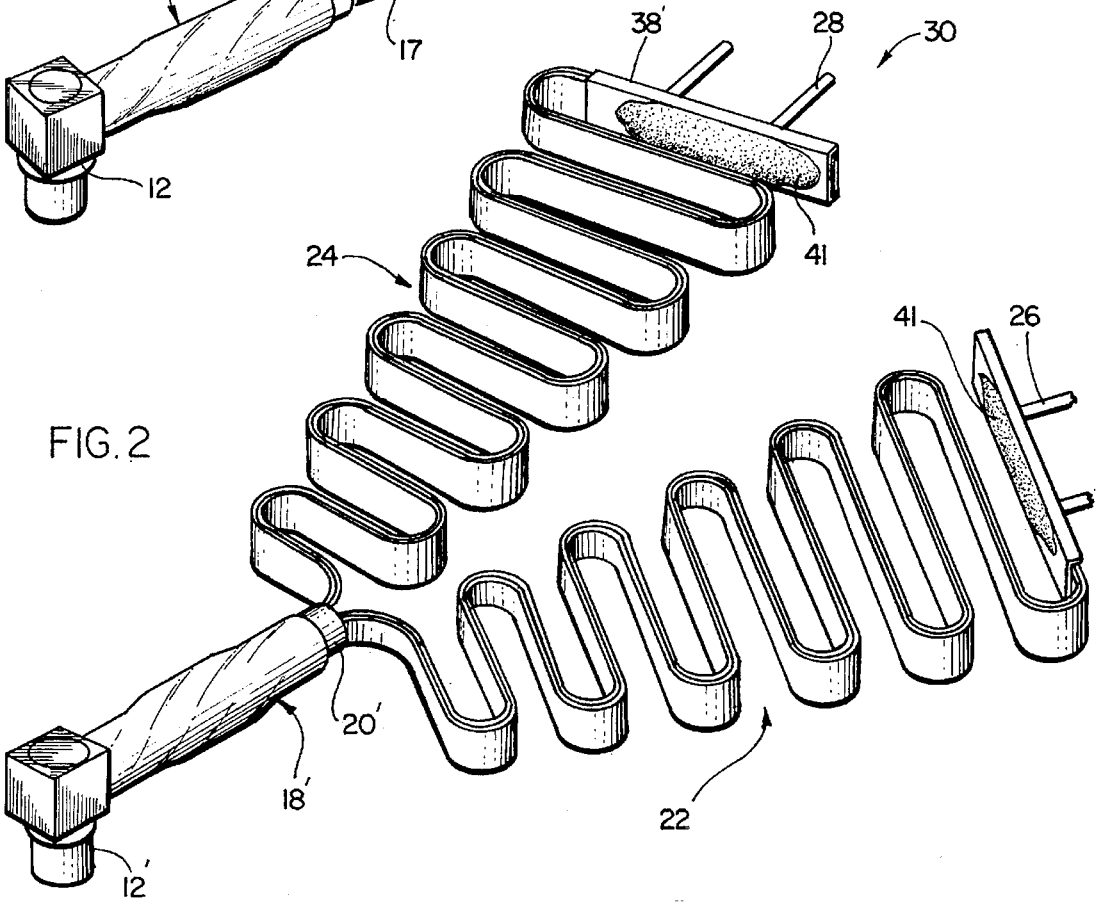
FIG. 2 is a perspective view of an alternative embodiment of a feed line according to the present invention.

An alternative embodiment of the invention, illustrated in FIG. 2, comprises a feed line 30 having dual resilient, conductive sections 22 and 24, which emerge from rigid base section 18' forming a "Y" shaped section. A first connector 12' establishes a signal path with the signal receiver/transmitter circuits (not shown), and each resilient section 22 and 24 terminates in a second connector 26 and 28, respectively, completing the conductive path to a single conductor of the antenna element (not shown). The use of dual conductive spring sections 22 and 24 provides a smoother transition between the output impedance of the signal circuits and the input impedance of the antenna element which is useful in applications where more sensitivity is required.

Figure 3:
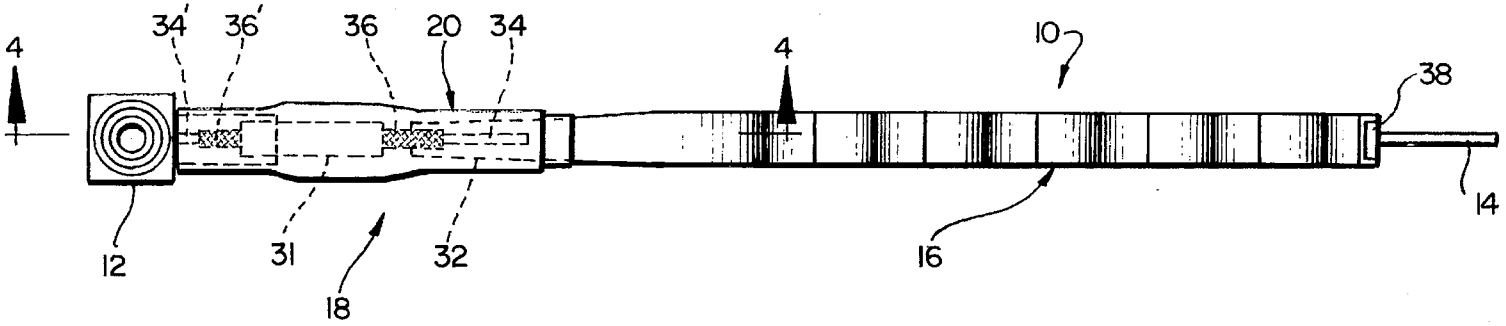
FIG. 3 is a section view of the feed line of FIG. 1.

The construction of a feed line in accordance with the present invention will be described with reference to FIGS. 3 and 4. Resilient spring section 16 is comprised of a strip of resilient material 16', which can be made of, for example, "S"-glass/PEEK (Poly Ether Ether Ketone), bonded to a thin strip of conductive material 16" by means of a pressure sensitive adhesive. 3M 1194 copper tape manufactured by 3M corporation can be used as the conductive material. Resilient strip 16' is constructed by folding strips of resilient material around a spring-shaped mandrel (not shown). The mandrel is then heated to 700° F. for 30 to 40 minutes. Finally, the strips are cooled to room temperature. When cooled, resilient strip 16' will retain its spring-like shape after being removed from the mandrel. In addition, strip 16' is highly resilient because the resin base of the resilient material cures to the S-glass fibers when the material is heated and then cooled. Conductive strips 16" are then bonded to one side of the resilient material to form resilient, conductive section 16.

After its formation, resilient section 16 has a straight portion 17 extending away from the spring-like fanfolds. A small section of resilient strip 16' is removed from straight portion 17 and the exposed conductive strip 16" is then folded over the resilient material remaining in straight portion 17. As a result, a folded strip section 32 having conductive material 16" on two sides is formed as illustrated in FIG. 4. Folded strip section 32 is then trimmed to form a taper, as best seen in FIG. 3.

Figure 4:
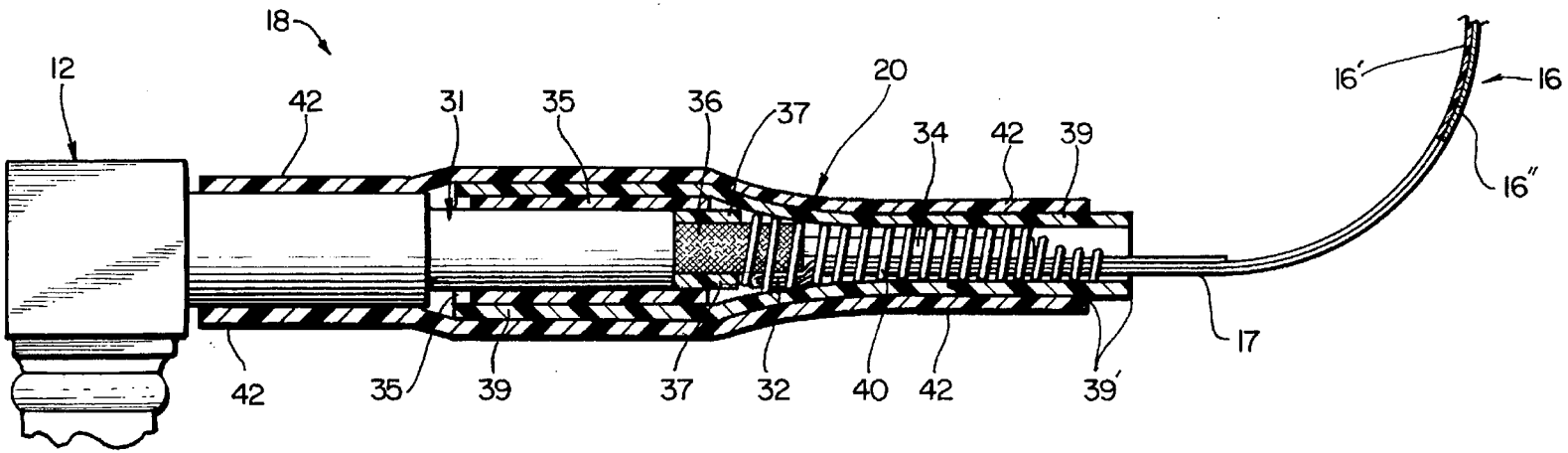
FIG. 4 is a partial section view of the feed line of FIG. 1 taken along line 4—4 of FIG. 3.

As illustrated in FIG. 4, base section 18 is formed from a short segment of coaxial cable 31 that is trimmed at one end to expose a portion of its central conductor 34 and braided shield 36 which covers the dielectric insulation (not shown) between conductor 34 and shield 36. Two partially overlying layers of heat shrink tubing 35 and 37 are then applied to the co-axial cable covering a portion of braided shield 36 leaving central conductor section 34 exposed. The tapered conductive strip 32 is then laid over central conductor 34 such that a small length of folded strip section 32 overlaps the braided shield 36. Next, central conductor 34 and folded strip 32 are soldered and wrapped with bus wire 40 to form flexible base joint 20. Heat shrink tubing 39 is applied to the base assembly covering the entire base joint 20. Finally, as shown in FIG. 3, the end of cable 31 opposite folded strip 32 is trimmed to expose the conductor 34' and a portion of braided shield and dielectric insulation 36'. Connector 12 is then crimped onto the exposed cable. A final layer of heat shrink tubing 42 is applied to cover nearly all of completed base section 18 leaving a small offset 39' (typically, 0.05 inches) of heat shrink tubing 39 exposed. The layers of heat shrink tubing 35, 37, 39 and 42 provide strain relief for the connectors between coaxial cable 31 and connector 12. In addition, the heat shrink tubing stiffens cable 31 so that it remains straight as it exits the barrel of connector 12.

As illustrated in FIG. 1, feed line 10 is completed with the addition of the antenna element connector 14 to the resilient conductive section 16 opposite connector 12. This is accomplished by first wrapping a small strip of conductive material 38 around resilient strip 16' and conductive strip 16" of section 16. This establishes a conductive connection between conductive material 38 and resilient section 16. Next, holes (not shown) are drilled through the conductive strip 38 and resilient conductive section 16. Connector 14, which can be a short section of copper wire formed into a 'C' shape, is inserted through the holes and soldered at junction 41 to conductive segment 38 to complete the conductive connection with resilient section 16.

A self-deployable antenna feed line constructed in accordance with this invention is extremely durable and lightweight by virtue of the materials used in its construction. In addition, because feed line 10 can expand or compress to accommodate shape distortions in the antenna system on which it is used, it can be used as part of a completely self-deployable antenna system.

Figure 5:
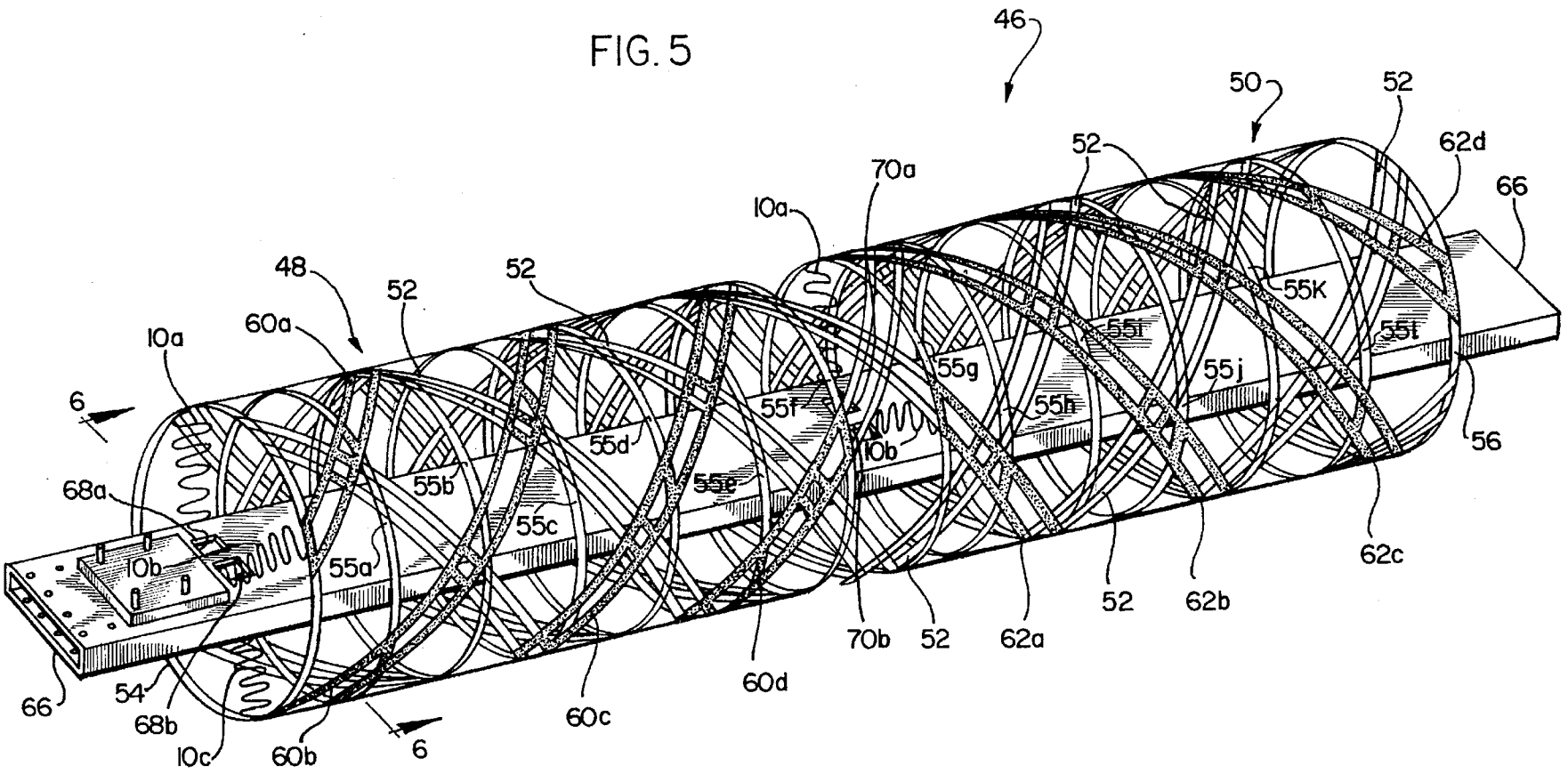
FIG. 5 is a perspective view of an antenna system for use with the present invention illustrated in its deployed position.

An antenna system for use with the present invention is illustrated in FIG. 5. The antenna system includes a quadrifiler helical antenna structure 46. Antenna structure 46 has a plurality of resilient helical strips 52 which are mounted to end rings 54 and 56 and intermediate rings 55*a–l*. The antenna is formed with the addition of conductive strips 60*a–d* and 62*a–d* that are bonded to some of resilient strips 52. In the preferred embodiment, antenna structure 46 comprises two independent antenna elements 48 and 50. Antenna element 48 includes conductive strips 60*a–d* wound so as to provide left-hand polarization, and antenna element 50 includes helical strips 62*a–d* wound so as to provide right-hand polarization, thereby providing two antennae of opposite polarizations.

Antenna structure 46 is lightweight, flexible and can be stowed for storage in a compact volume. Moreover, structure 46, when released from its stowed confinement, will self-deploy by the energy stored in the resilient helical strips as they resume their helical configuration. A detailed disclosure of the structure of helical antenna structure 46 is described in the co-pending U.S. Patent Application, the contents of which are hereby incorporated by reference, entitled "Self-Deploying Helical Structure", Ser. No. 08/192,324, filed Feb. 4, 1994, and assigned to the assignee of the present invention.

In operation, antenna structure 46 is installed with a boom 66 extending through its center. As best seen in cross-sectional views 6 and 7, housed within boom structure 66 are circuit boards 72 which provide signals to and/or receive signals from each antenna element 48 and 50. For each antenna element 48 and 50, boom 66 includes four signal feed holes, 68*a–d* and 70*a–d*, respectively. The four helical conductors 60*a–d* and 62*a–d* of each antenna element 48 and 50, respectively, are connected to signal circuits 72 by feed lines 10*a–d* which emerge from signal holes 68*a–d* and 70*a–d*, respectively. Feed lines 10*a–d* are connected to signal circuits 72 by connectors 16*a–d* and terminate at helical conductors 60*a–d* and 62*a–d* by means of connectors 14*a–d*. To complete the conductive connection between helical conductors 60*a–d* and 62*a–d* and signal circuit boards 72, two wholes are drilled through each conductor at end ring 54 through which the two prongs of each connector 14*a–d* are inserted. The prongs are then bent 90° towards each other so that they lie flat against each conductor 60*a–d* and 62*a–d*. The prongs are then soldered into place forming conductive junctions 61*a–d*.

It should be appreciated that antenna system 46 equipped with feed lines 10*a–d* is lightweight, durable and completely self-deployable. Therefore, it is a highly advantageous design for space applications where payload weight and space are at a premium and system reliability is critical. Moreover, because feed lines 10*a–d* can be constructed with the same materials used in the construction of helical antenna structure 46, the coefficient of thermal expansion of feed lines 10*a–d* match that of antenna structure 46. As a result, the thermal stress encountered by conductive strips 16" of feed lines 10*a–d* is significantly reduced. This is particularly advantageous in space applications where the ambient temperature can vary from between −100° to 100° C.

Figure 6:
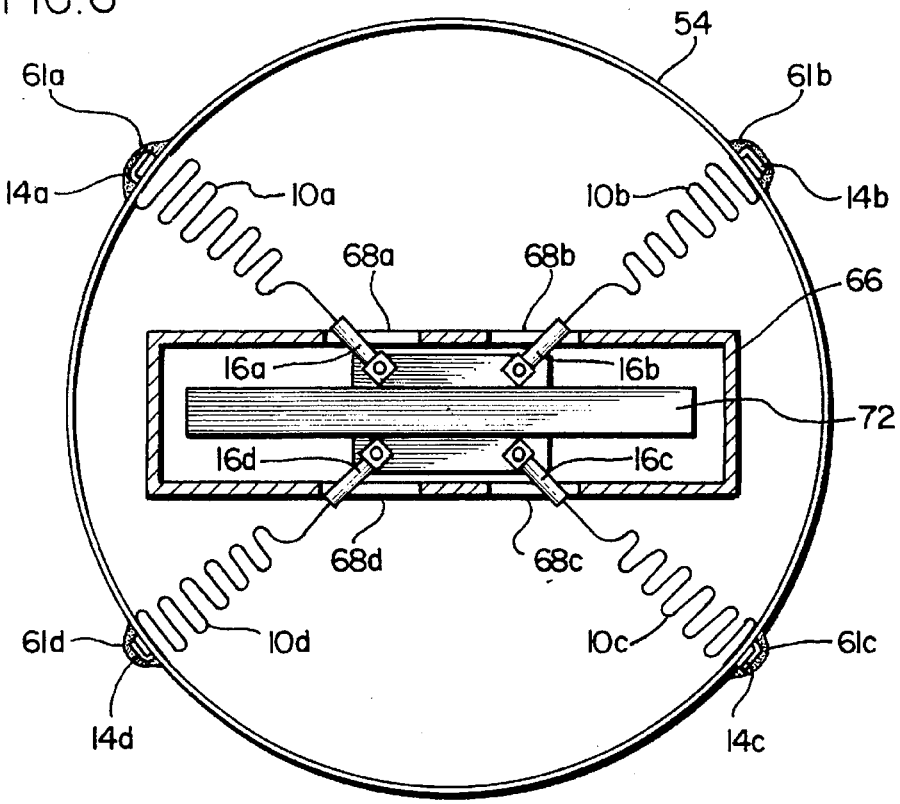
FIG. 6 is a cross-section view of the antenna system of FIG. 4 taken along line 6—6 of FIG. 5.

As can be seen in FIG. 6, with antenna structure 46 deployed, each of the resilient spring sections 16 of feed lines 10*a–d* are slightly expanded and each conductor lies in the same plane, thus providing identical signal paths to each of the conductors of the antenna element. As a result, the individual conductors 60*a–d* and 62*a–d* are fed with a proper phase progression and amplitude so that a proper signal pattern is generated by each antenna element 48 and 50.

Figure 8:
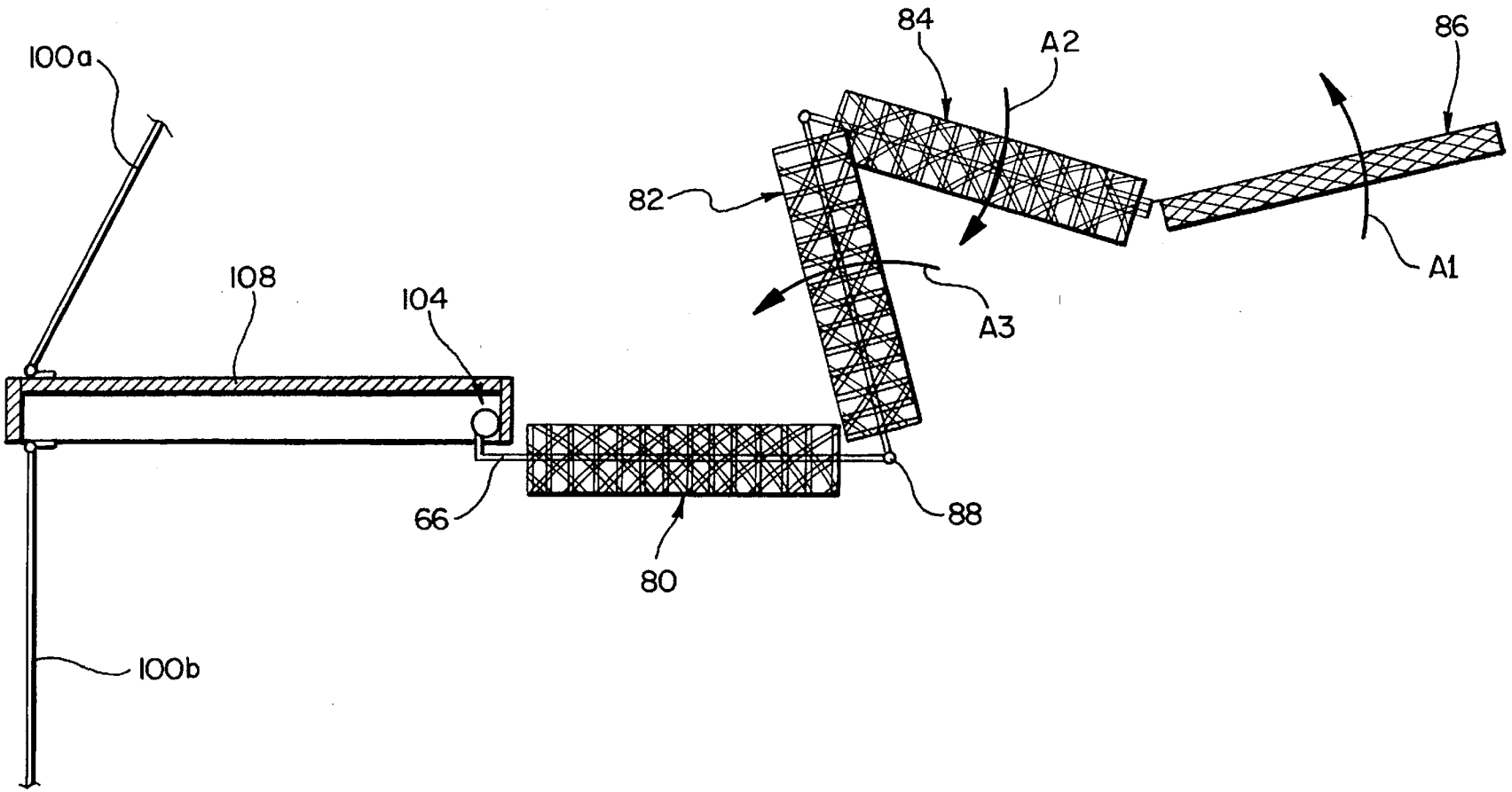
FIG. 8 is a section view of an alternative antenna system partially deformed toward its stowed position.

FIG. 8 illustrates an alternative embodiment of the present section wherein individual helical structures 80, 82, 84 and 86 are axially arrayed along a central boom structure 66. The boom 66 is divided into segments by hinges 88 such that the entire array of antenna elements folds upon itself about hinge 104, as indicated by arrows A1–A3. As a result, antenna structures 80 through 86 are resiliently compressed to occupy a smaller thickness along their entire length, and thereby fit compactly within the space provided between shelf 108 and solar array panel 100*b*.

Figure 7:
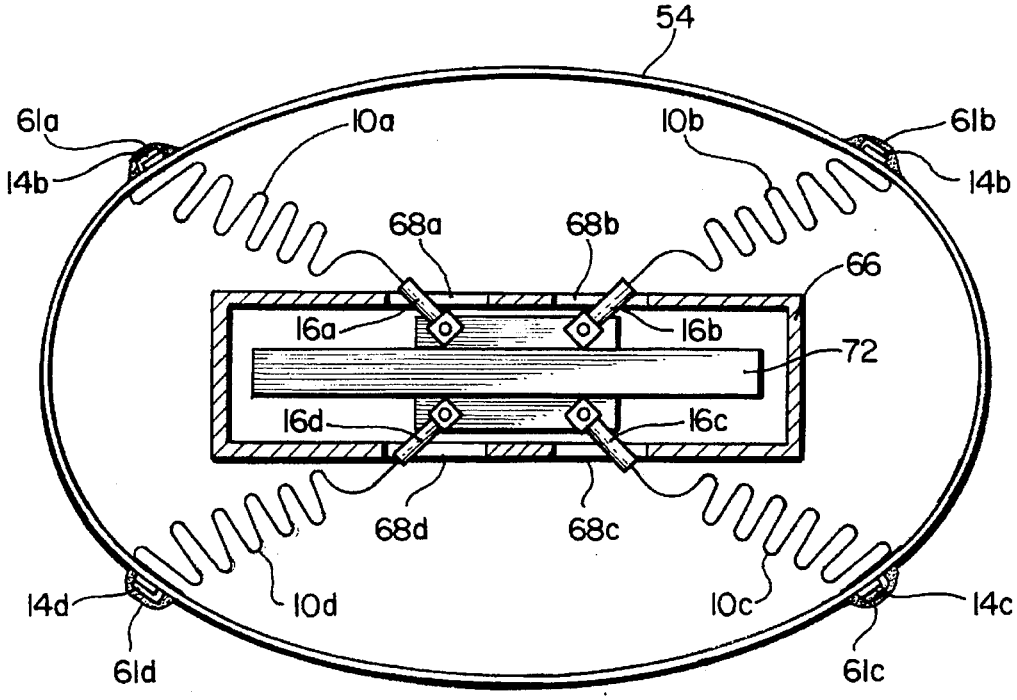
FIG. 7 is a cross-section view of the antenna system as in FIG. 6 illustrated in a partially stowed configuration.

The effect of antenna stowage on feed lines 10*a–d* is illustrated in FIGS. 6 and 7. As antenna structures 80–86 are compressed during stowage, the structural rings at the feed points of each antenna element are compressed to form an elliptical shape (only structural ring 54 of antenna element 48 being shown in FIGS. 6 and 7). Feed lines 10*a–d* expand as shown in FIG. 7 to accommodate the oval shape of the antenna structure rings 54 during stowage. Subsequently, when the antenna is redeployed, feed lines 10*a–d* also self-deploy resuming their normal shape, as shown in FIG. 6. Conductive segments 10*a–d* are taught (i.e., slightly expanded) when antenna structure 46 is redeployed, and each of the feed lines 10*a–d* is in a common plane so that the signal paths from signal receiver/transmitter circuits 72 to helical conductive strips 60*a–d* are identical.

While illustrative embodiments of the invention are shown in the drawings and are described in detail herein, the invention is susceptible of embodiment in many different forms. It should be understood that the present disclosure is to be considered as an exemplification of the principles of the invention and is not intended to limit the invention to the embodiment illustrated.

I claim:

1. A flexible feed line for use with an antenna system having an alternatively stowable and redeployable antenna element, said feed line comprising:

first connection means for providing a signal connection with said feed line;

second connection means for establishing a signal connection with said antenna element; and at least one expandable and resilient conductive section made of a non-ferrous material formed into a spring-like, zig-zag pattern of multiple folds connected between said first connection means and said second connection means, so that said resilient section resiliently alters its shape to a first orientation when said antenna element is stowed and resiliently alters its shape to a second orientation when said antenna element is subsequently deployed.

2. The feed line of claim 1 further comprising a base section connected between said first connection means and said resilient conductive section.

3. The feed line of claim 2 wherein said base section comprises a coaxial cable, connected between said first connection means and said resilient conductive section, said coaxial cable being coated with at least one layer of plastic tubing.

4. The feed line of claim 3 wherein said base section further comprises flexible connection means for establishing an electrical connection between said coaxial cable and said resilient conductive section.

5. The feed line of claim 1 wherein said resilient conductive section comprises a conductive strip bonded to a strip of resilient material having a front side and a back side, said conductive strip substantially covering one of said sides of said strip of resilient material.

6. The feed line of claim 5 wherein said resilient material is "S"-Glass poly ether ether ketone and said conductive strip is copper tape having an adhesive surface.

7. A flexible feed line for use with an antenna system having an alternately stowable and deployable antenna element, said feed line comprising:

first connection means for providing a signal connection to said feed line;

second connection means for establishing a signal connection between the feed line and said antenna element; and at least one expandable and resilient conductive section made of a non-ferrous material formed into a spring-like, zig-zag pattern of multiple folds connected between said first connection means and said second connection means, so that said resilient section resiliently alters its shape to a first orientation when said antenna element is stowed and resiliently alters its shape to a second orientation when said antenna element is subsequently deployed;

wherein said resilient conductive section comprises a conductive strip bonded to a strip of resilient material; and wherein at least one said resilient conductive section comprises two spring-like sections that emanate from a base section connected between said first connection means and said resilient conductive section, said two spring-like sections and said base section forming a "Y" shape.

8. The feed line of claim 7 wherein the folds of said spring-like sections are of gradually increasing length from said first connection means to said second connection means.

9. A flexible feed line for use with an antenna system having an alternately stowable and deployable antenna element, said feed line comprising:

first connection means for providing a signal connection to said feed line;

second connection means for establishing a signal connection between the feed line and said antenna element; and at least one expandable and resilient conductive section made of a non-ferrous material formed into a spring-like, zig-zag pattern of multiple folds connected between said first connection means and said second connection means, so that said resilient section resiliently alters its shape to a first orientation when said antenna element is stowed and resiliently alters its shape to a second orientation when said antenna element is subsequently deployed;

wherein the folds of each said resilient conductive section are of gradually increasing length from said first connection means to said second connection means.

10. An antenna system comprising:

a collapsible antenna element having at least one resilient conductive segment attached thereto, said collapsible antenna element being collapsible for stowage and expandable for deployment;

a mounting structure for supporting said antenna element and having a housing for attaching an external signal circuit; and resilient signal conducting means for establishing a signal path between each said conductive segment and said external signal circuit, wherein said signal conducting means resiliently alters its shape to a first orientation when said collapsible antenna element is collapsed for stowage and resiliently alters its shape to a second orientation when said antenna element expands for deployment, said resilient signal conducting means further comprising a feed line for each said conductive segment of said antenna element having a first connection means for establishing a signal connection with said external signal circuit, a second connection means for establishing a signal connection with said resilient conductive segment of said antenna element and at least one resilient conducting section made of a non-ferrous material formed into a spring-like section of multiple folds between said first connection means and said second connection means.

11. The antenna system of claim 10 wherein said resilient conducting section of each said feed line comprises a conductive strip bonded to a strip of resilient material having a front side and a back side, said conductive strip substantially covering one of said sides of said strip of resilient material.

12. The antenna system of claim 11 wherein said mounting structure comprises an elongated member extending longitudinally within said antenna element and having an internal section that houses said external signal circuit.

13. The antenna system of claim 12 wherein each said feed line extends perpendicularly from said mounting structure so that each said feed line lies in the same plane when said antenna element is deployed.

14. The antenna system of claim 11 wherein said antenna element is a quadrifilar helical antenna element having four resilient conductive segments helically wound about a common central axis.

15. The antenna system of claim 14 wherein said mounting structure comprises a gravity gradient boom extending longitudinally along said common axis of said helical antenna element having a substantially rectangular cross-section and an internal cavity for housing said external signal circuit.

16. The antenna system of claim 15 wherein each said feed line extends radially from said gravity gradient boom so that each feed line lies in the same plane when said antenna element is deployed.

17. The antenna system of claim 16 wherein said antenna element collapses laterally about said gravity gradient boom when stowed so that the resilient conducting section of said feed line resilientlly alters its shape to a first orientation when said antenna element is stowed and resilientlly alters its shape to a second orientation when said element is deployed.

18. The antenna system of claim 10 wherein said antenna element comprises a helical structure and said resilient conductive segment is a conductive helical strip.

19. A flexible feed line for use with an antenna system having an antenna element, said feed line comprising:

first connection means for providing a signal connection to said feed line;

second connection means for establishing a connection between the feed line and said antenna element; and at least one expandable and resilient conductive section formed into a zig-zag pattern of multiple folds connected between said first connection means and said second connection means.

20. The feed line of claim 19 wherein said resilient conductive section comprises a conductive strip bonded to a strip of resilient material having a front side and a back side, said conductive strip substantially covering one of said sides of said strip of resilient material.

21. A flexible feed line for use with an antenna system having an antenna element, said feed line comprising:

first connection means for providing a signal connection to said feed line;

second connection means for establishing a connection between said feed line and said antenna element; and at least one expandable and resilient conductive section formed into a zig-zag pattern of multiple folds connected between said first connection means and said second connection means, wherein said resilient conductive section comprises two spring-like sections that emanate from a base section connected between said first connection means and said resilient conductive section, said two spring-like sections and said base section forming a "Y" shape.

22. The feed line of claim 21 wherein the folds of said spring-like sections are of gradually increasing length from said first connection means to said second connection means.

23. A flexible feed line for use with an antenna system having an antenna element, said feed line comprising:

first connection means for providing a signal connection to said feed line;

second connection means for establishing a connection between the feed line and said antenna element; and at least one expandable and resilient conductive section formed into a zig-zag pattern of multiple folds connected between said first connection means and said second connection means, wherein the folds of said resilient conductive section are of gradually increasing length from said first connection means to said second connection means.

* * * * *